US007568813B2

(12) United States Patent
Barker

(10) Patent No.: US 7,568,813 B2
(45) Date of Patent: Aug. 4, 2009

(54) CHEST HEIGHT LIGHT EMISSION SYSTEM

(75) Inventor: Paul H. Barker, 6155 S. Oneida Way, Centennial, CO (US) 80111

(73) Assignee: Paul H. Barker, Centennial, CO (US)

( * ) Notice: Subject to any disclaimer, the term of this patent is extended or adjusted under 35 U.S.C. 154(b) by 0 days.

(21) Appl. No.: 11/455,259

(22) Filed: Jun. 16, 2006

(65) Prior Publication Data

US 2006/0285314 A1 Dec. 21, 2006

Related U.S. Application Data

(60) Provisional application No. 60/691,375, filed on Jun. 17, 2005.

(51) Int. Cl.
*F21V 7/08* (2006.01)

(52) U.S. Cl. ..... 362/108; 362/103; 362/191

(58) Field of Classification Search ..... 362/103, 362/108, 191–200, 270, 205
See application file for complete search history.

(56) References Cited

U.S. PATENT DOCUMENTS

| | | | | |
|---|---|---|---|---|
| 2,275,765 | A * | 3/1942 | Nixon et al. | 362/108 |
| 3,944,803 | A | 3/1976 | Chao | |
| 3,953,722 | A | 4/1976 | Stick | |
| 4,112,482 | A | 9/1978 | Powell | |
| 4,231,079 | A | 10/1980 | Heminover | |
| 4,283,756 | A | 8/1981 | Beamon | |
| 4,319,309 | A | 3/1982 | Benoit | |
| 4,328,533 | A | 5/1982 | Paredes | |
| 4,451,871 | A | 5/1984 | Kirkley et al. | |
| 4,521,832 | A | 6/1985 | Barbour | |
| 4,523,258 | A | 6/1985 | Morse et al. | |
| 4,652,981 | A | 3/1987 | Glynn | |
| 4,774,642 | A | 9/1988 | Janko et al. | |
| 4,812,953 | A | 3/1989 | Ask et al. | |
| 4,893,221 | A * | 1/1990 | Friedman | 362/108 |
| 5,063,483 | A | 11/1991 | Feilmeier et al. | |
| 5,268,826 | A | 12/1993 | Greene | |
| 5,359,501 | A * | 10/1994 | Stevens | 362/108 |
| 5,567,037 | A | 10/1996 | Ferber | |
| 6,056,412 | A | 5/2000 | Atlee et al. | |
| 6,267,482 | B1 | 7/2001 | Miller et al. | |
| 6,554,445 | B1 * | 4/2003 | Jacoby | 362/108 |
| 6,578,982 | B1 | 6/2003 | Lynch | |
| 6,644,826 | B1 | 11/2003 | Blum | |
| 7,185,997 | B2 * | 3/2007 | Simoni | 362/108 |

OTHER PUBLICATIONS

U.S. Appl. No. 60/691,375, Barker, Paul H.
Luxeon by Lumileds, Portable Lighting Designer's Guide, two pages—cover page and description page with various tables.

* cited by examiner

*Primary Examiner*—John A Ward
(74) *Attorney, Agent, or Firm*—Craig Miles; CR Miles, P.C.

(57) ABSTRACT

An illumination device worn at chest height to illuminate an area proximate to the wearer.

11 Claims, 9 Drawing Sheets

CHEST HEIGHT LIGHT EMISSION SYSTEM

This United States Patent Application claims the benefit of U.S. Provisional Patent Application No. 60/691,375, filed Jun. 17, 2005, hereby incorporated by reference herein.

I. BACKGROUND

A light emission system for illumination of an area proximate to the wearer.

Various work and recreational activities are performed outside between dusk and dawn, inside buildings insufficiently lit for certain activities, or otherwise in insufficiently lit environments which necessitate or make desirable the use of an illumination device to increase the amount of light. Due to the prevalence of activities in which additional light is desired, there is a high demand for portable illumination sources which remain stationary or are worn on the body. This demand has spawned a numerous and wide variety of illumination devices such as those disclosed by U.S. Pat. Nos. 3,944,803; 3,953,722; 4,112,482; 4,231,079; 4,283,756; 4,319,309; 4,451,871; 4,521,832; 4,522,258; 4,652,981; 4,774,642; 4,872,953; 4,045,979; 5,063,483; 5,350,461; 5,567,037; 6,056,412; 6,267,482; 6,578,982; and 6,644,826.

Despite the high demand which continues to drive development of additional illumination devices and the numerous and varied illumination devices already available in the marketplace, a number of problems with respect to providing illumination for activities to increase visibility remain unresolved.

A significant problem with conventional portable illumination devices can be that the device cannot be worn by a person or cannot be worn for certain activities. A variety of conventional portable illumination devices are configured for stationary location on a support surface. Other conventional portable illumination devices are configured to be worn by a person as disclosed for example by the above-listed United States Patent Nos.; however, the configuration, size or weight of the conventional illumination device makes impractical using the illumination device for rigorous activities such as hiking, climbing, bicycling, or running as disclosed for example by U.S. Pat. Nos. 3,953,722; 4,319,309; 4,328,533;

Another significant problem with conventional portable illumination devices can be that the device is worn at the waist of a person as disclosed for example by U.S. Pat. Nos. 4,112,482; 4,283,756; 4,521,832; 4,523,258; 4,652,981; or 4,812,953. One aspect of this problem can be that illumination devices worn at waist level can interfere with the movement of the legs of the wearer. This can be particularly true when the legs travel through an extended range of motion as when bicycling or running. Another aspect of this problem can be that the illumination cast by an illumination device established at waist height can in whole or part be blocked or obscured by the movement of the arms or the legs. Yet another aspect of this problem can be that location of the field of illumination (or travel of the field of illumination) can be coupled to the movement of the arms or legs (movement of the arms or legs results in a corresponding movement of the location of the field of illumination) which may locate the field of illumination away from the direction in which the wearer is traveling. As such, the field of illumination may not properly located (whether at all times or part of the time) for the wearer to visualize the path of travel.

Another significant problem with conventional portable illumination devices can be that the device is worn on the head or neck as disclosed for example by U.S. Pat. Nos. 4,231,079; 3,944,803; 5,268,826. One aspect of this problem can be that the configuration or weight of the conventional illumination device worn on the head or neck can cause strain on the head or neck muscles. Another aspect of this problem similar to that above-described can be that the location of the field of illumination may be coupled to movement of the head or neck. That is, as the head or neck moves the location of the field of illumination may correspondingly move or travel. Again, the field of illumination may not properly located (whether at all times or part of the time) for the wearer to visualize the path of travel.

Yet another significant problem with conventional portable illumination devices can be insufficient illumination of the area of activity. A first aspect of the problem may be an insufficient radiance of the light source or amount of energy released from the light source. Another aspect of this problem may be insufficient illuminance or intensity or degree to which the area of activity is illuminated. This may not be a function of the amount light produced by the illumination source of the illumination device, but rather the manner of focusing or make the angle of the light emitted optimal to increase foot candles or LUX in the area of activity. For example, the angle of the light emitted relative to the field of illumination may not be optimal when the illumination device is worn on the head, neck, or at waist height and as described above may lack constancy as to location due to movement of as above-described.

Still another significant problem with conventional portable illumination devices can be that the device does not provide sufficient illumination of the wearer's eyes. The iris of the eye adjusts to the incident light on the eye. When the eye is conditioned to a level of light an increased illuminance upon the eye can be blinding because the iris cannot contract rapidly enough to reduce the light incident to the retina. Additionally, the iris of the eye can overreact to the increased illuminance reducing the amount of light incident to the retina for a duration of time. As such, when the work or recreational activity performed makes the eye incident to rapid increases in illuminance, the person can be blind or have lowered visual acuity for such duration of time. For example, a person running or walking at night may be temporarily blinded by the light of oncoming automobiles. During that period of temporary blindness, the runner or walker being unable to see or having lowered visual acuity for a duration of time, in which several steps may be taken when walking or running, can be at increased risk of injury.

The illumination device and methods of making and using an illumination device described below addresses each of these problems of conventional light emitting devices in a practical manner.

II. SUMMARY OF THE INVENTION

Accordingly, a broad object of the invention can be to provide a portable illumination device which can be worn by a person during work or recreational activities which emits light of sufficient radiance or illumination.

Another broad object of the illumination invention can be to provide an illumination device configured for rigorous activities such as hiking, climbing, bicycling, or running.

Another significant object of the illumination invention can be to provide a portable illumination device worn at chest height. Establishing the illumination device at chest height avoids contact between the illumination device and the arms or legs of the wearer. Additionally, establishing the illumination device at a chest height location avoids blocking of the light emitted by the illumination device by the arm or legs of the wearer. Importantly, establishing the illumination device at chest height location couples travel of the field of illumination to movement of the chest height location and uncouples travel of the field of illumination from movement of other parts of the wearer's body, such as the head, neck, legs, or arms. For example, establishing the illumination device at a chest height location on the front of a wearer can generate a field of illumination having a location relative to the wearer which remains substantially fixed even though the head or other parts of the wearer's body may be in motion. Another advantage of establishing the illumination invention at chest height can be a reduction in the stress on head and neck muscles.

Another significant object of the illumination invention can be to provide a portable illumination invention which conditions the response of the eye to avoid temporary blindness or lessen reduction in visual acuity, or maintain visual acuity due to a rapid increase or decrease in light intensity incident upon the eye.

Naturally, further objects of the invention are set forth in the specification and drawings.

III. A BRIEF DESCRIPTION OF THE DRAWINGS

Figure 9:
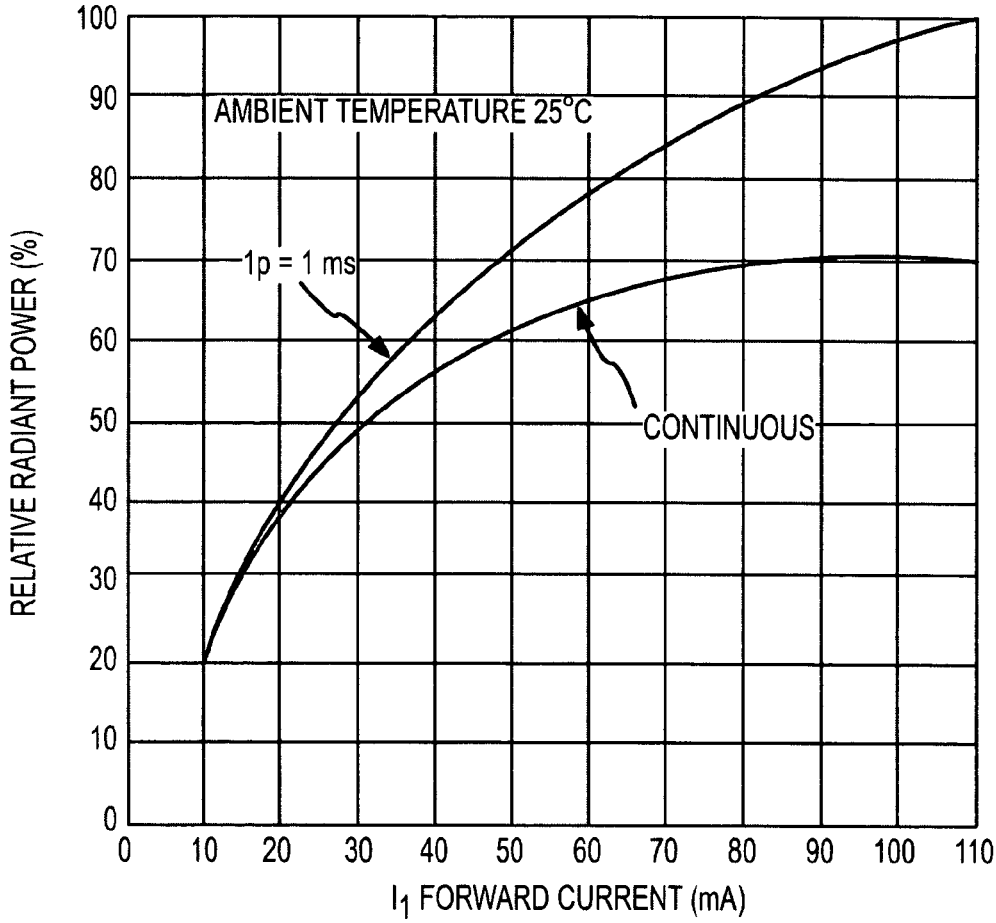

FIG. 9 provides a graph of relative radiant power of a light emitting diode comparing continuous duty and non-continuous duty of the light emitter.

Figure 10:
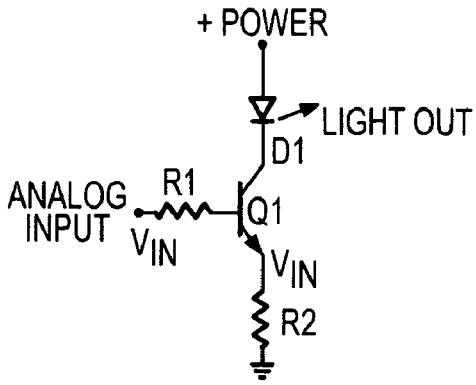

FIG. 10 provides an embodiment of an analog driver circuit for a light emitting diode.

Figure 11:
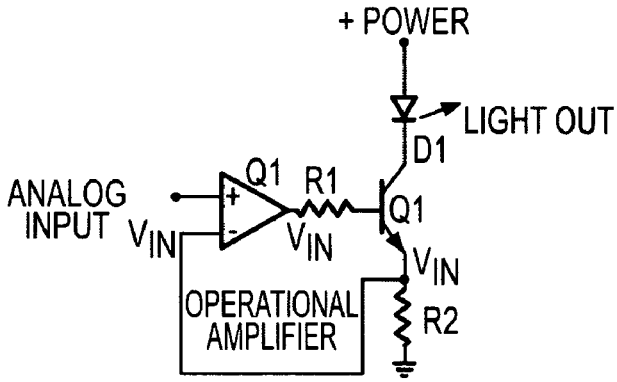

FIG. 11 provides an alternate embodiment of an analog driver circuit for a light emitting diode.

Figure 12:
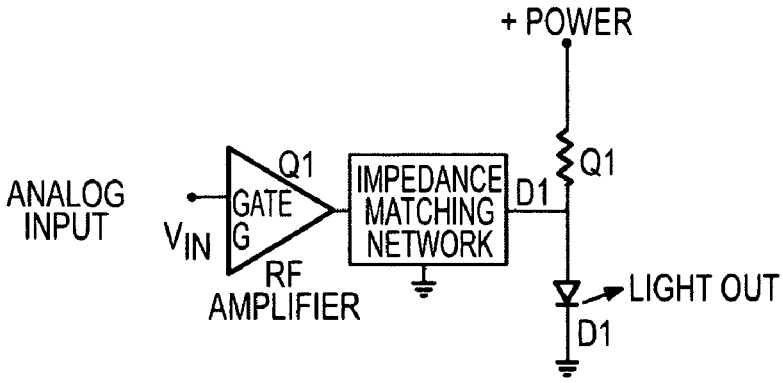

FIG. 12 provides an alternate embodiment of an analog driver circuit for a light emitting diode.

Figure 13:
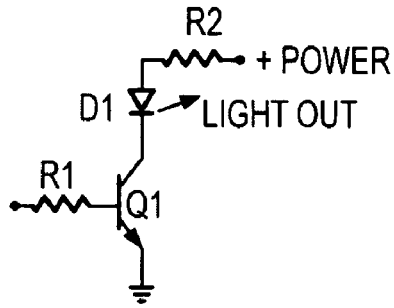

FIG. 13 provides an embodiment of an digital driver circuit for a light emitting diode.

Figure 14:
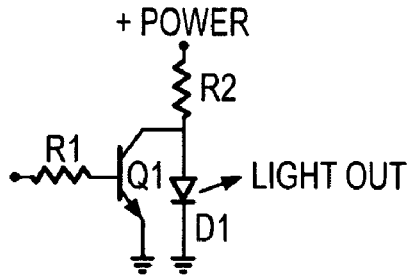

FIG. 14 provides an alternate embodiment of an digital driver circuit for a light emitting diode.

Figure 15:
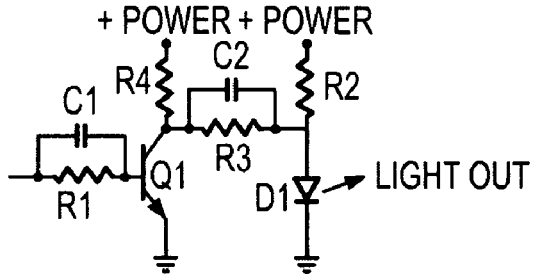

FIG. 15 provides an alternate embodiment of a digital driver circuit for a light emitting diode.

Figure 16:
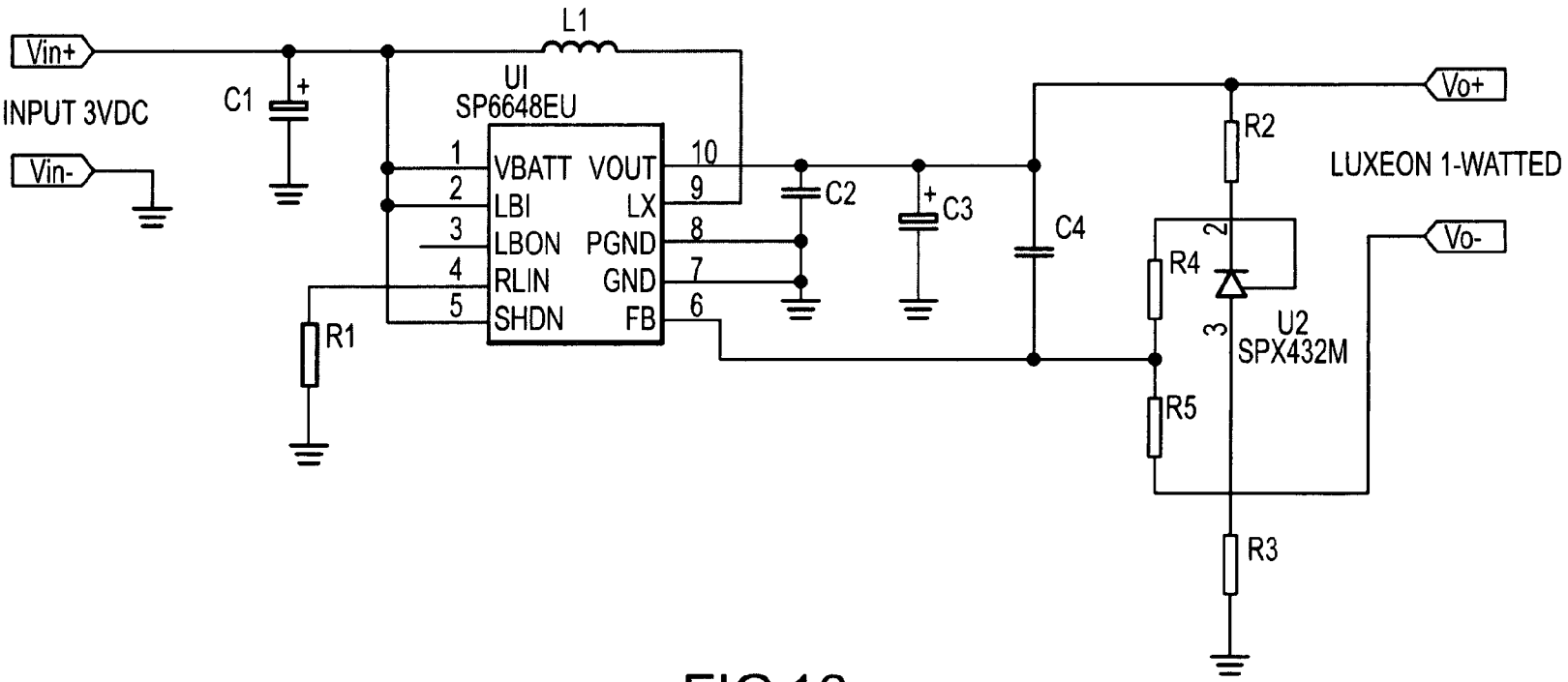

FIG. 16 provides an alternate embodiment of a digital driver circuit for a light emitting diode.

IV. DETAILED DESCRIPTION OF THE PREFERRED EMBODIMENTS

A preferred embodiment of the inventive illumination device can be worn at chest height to illuminate the area proximate to the wearer. Now referring primarily to FIG. 1, the illumination device (1) can be worn by a person (2) (or wearer) to illuminate a path (3) in the direction of travel. As to this preferred embodiment of the invention the illumination invention (1) can be established at chest height (4)(as described below) by adjusting a restraint (5) connected to an illumination assembly (6). The term "chest height" generically encompasses the tubular region of a person between about the level of the armpits and about the level of naval (above the waist). The term is not intended to be limiting with respect to the location at which the illumination assembly can be established on the tubular region of the wearer and the illumination assembly can be established on the front side, the back side, or at any other desired location on the tubular region each being a chest height location. Typically, a chest height location establishes the illumination assembly on the front of the wearer about midway between the naval and the armpits as shown for example in FIG. 1.

Figure 1:
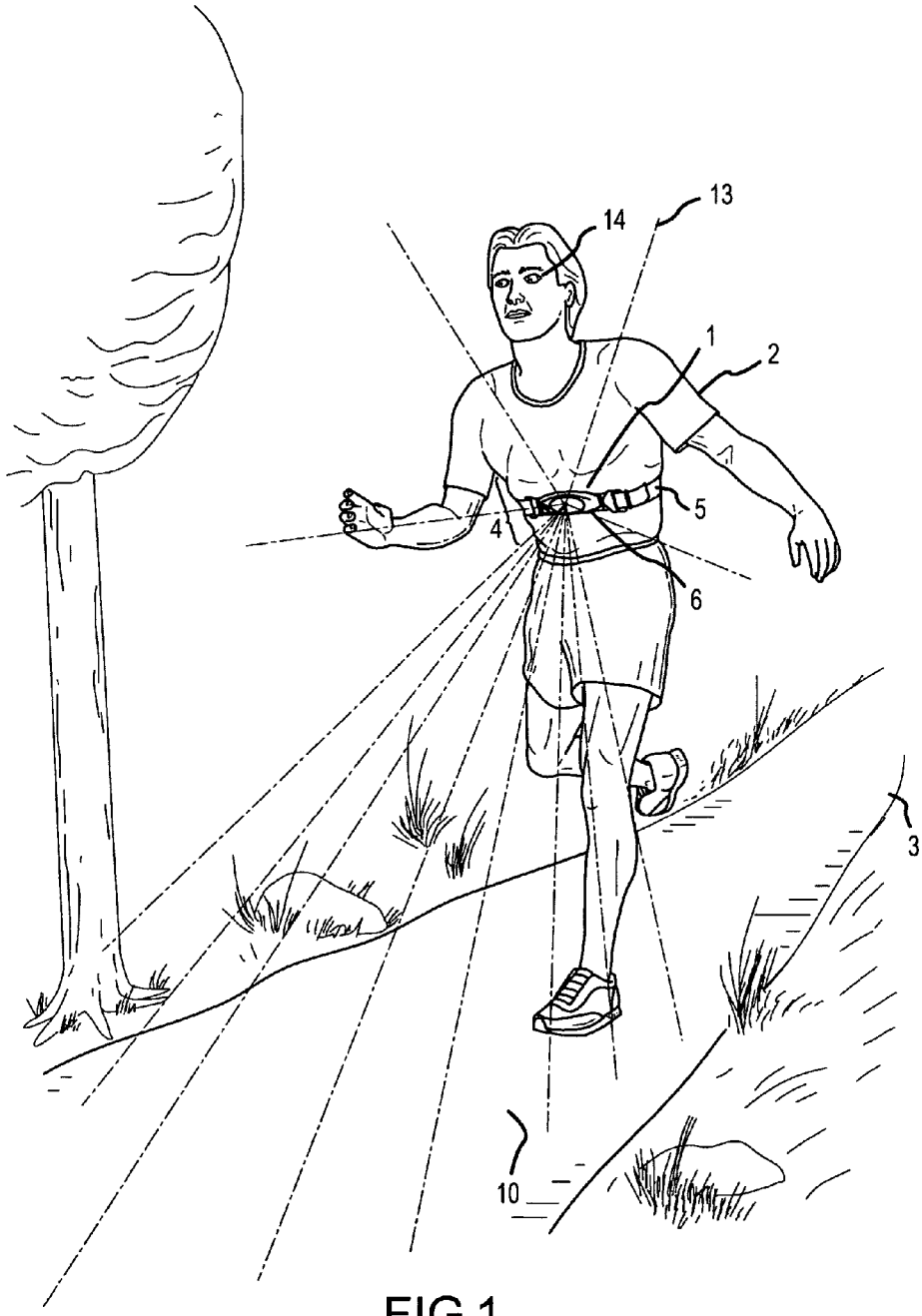
FIG. 1 shows a method of using the invention during walking, running, or jogging.

Also, while the preferred embodiment of the invention can be useful to runners as shown in FIG. 1, the inventive illumination device is not intended to be limited only to use by runners and establishing the illumination assembly at chest height can be useful to persons engaged in any manner of work or recreational activity whether inside or outside a building, including without limitation: construction, camping, bicycling, fishing, running, jogging, walking, reading, fly tying, or like.

Figure 2:
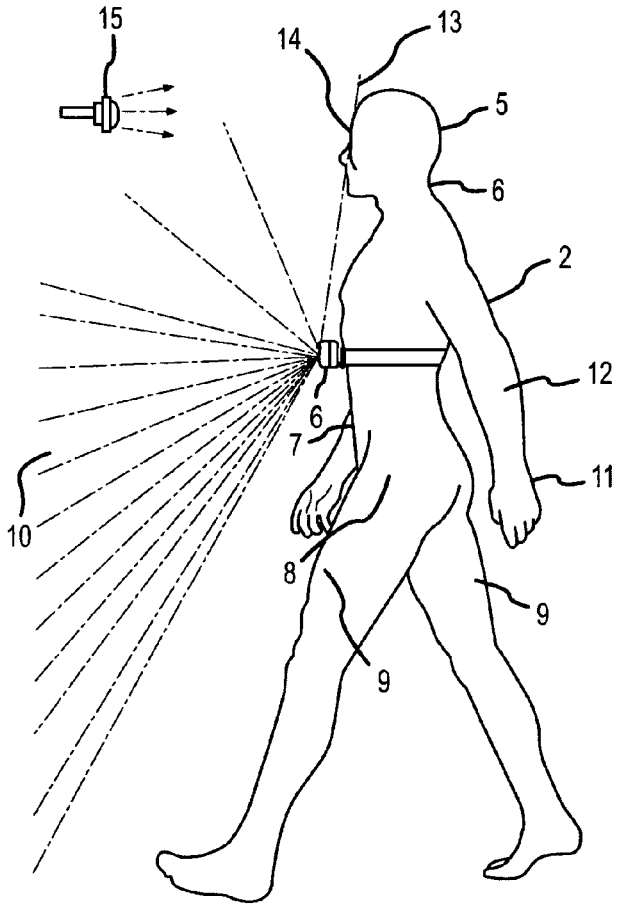
FIG. 2 is a side view of a particular embodiment of the illumination invention established at chest height.
Figure 3:
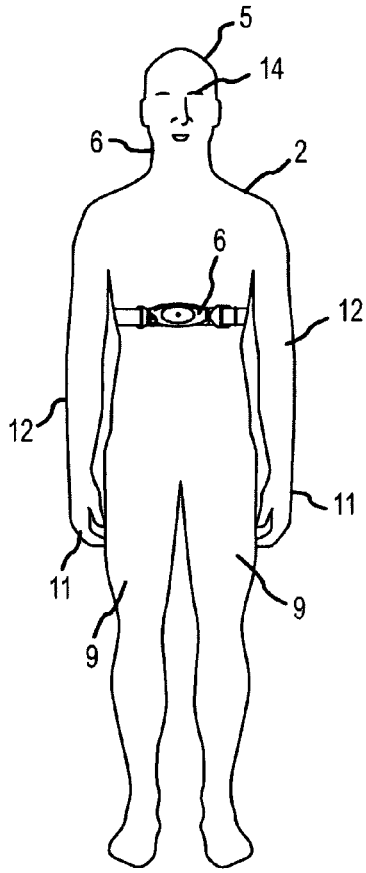
FIG. 3 is front view of a particular embodiment of the illumination invention established at chest height.

Now referring primarily to FIGS. 2 and 3, establishing the illumination assembly at chest height (4) as shown confers a variety of advantages to the wearer. A first advantage of establishing the illumination assembly (6) at chest height (4) (or at a chest height location) can be to uncouple the location of field of illumination (10) from the movement of the head (5), neck (6), waist (7), hips (8), arms (12) or legs (9). For example, while the head (5) or neck (6) may periodically turn to afford an extended field of vision, it may be preferable to have the location of the field of illumination (10) remain substantially fixed (subject only to motion of the chest height location), substantially fixed in a particular direction of travel, or substantially fixed relative to the wearer (whether or not the wearer is in motion). By establishing the illumination assembly (6) at chest height (4), the head (5) and neck (6) can be turned without substantially altering the location of the field of illumination (10) or the direction in which the field of illumination is traveling. Similarly, it can be advantageous to uncouple the location of the illumination (10) assembly from the movement of the waist (7), hips (8), or legs (9) to maintain location of the field of illumination (10) substantially fixed, substantially fixed in a particular direction of travel, or substantially fixed relative to the wearer whether the wearer is stationary or travels.

Another advantage of establishing the illumination assembly (6) at chest height can be avoidance of the hand (11), arms (12), or legs (9) from interference with the field of illumination (10). Establishing the illumination assembly (6) at a chest height location increases both constancy as to the area illuminated and constancy as the intensity of the light incident to the area illuminated.

A further advantage of establishing the illumination assembly (6) at chest height (4) can be a reduced probability of contact with the hands (11), arms (12), or legs (9) of the wearer (2). In the first instance, this allows a greater range of motion with respect to the travel of the hands (11), arms (12), legs (9), waist (7) or hips (8) of the wearer while performing a desired activity. Another aspect of this advantage can be that the wearer (2) can avoid injury due to contact with the illumination assembly (6). Additionally, less movement of and contact with the illumination assembly (6) can reduce wear and tear on the inventive illumination device (1).

Now referring primarily to FIG. 2, a further advantage of establishing the illumination assembly (6) at chest height (4) can be that the illumination assembly can be affirmatively configured to generate a field of illumination having sufficient area and luminance to generate a light tolerant eye. Affirmatively configured means constructional forms of the illumination assembly worn at chest height for the purpose of generating a field of illumination having sufficient constancy as to the location of the area illuminated and sufficient constancy as the illuminance of the field of illumination to establish a light tolerant eye. As to certain embodiments of the inventive illumination device establishing the correct level of illumination incident on at least one eye or both eyes to establish a light tolerant eye can be the result of the illuminance of the field of illumination or the result of directing a part of the emitted light directly upon at least one or both eyes, or a combination of both. A light tolerant eye established by visualizing the field of illumination generated by the inventive illumination assembly established at chest height compared to a normal eye accustomed to illumination of conventional light emitting devices has a greater ability (or lesser reduction in ability) to resolve a visual target after incidence of a second light emission upon the eye (light from a source discrete from the field of illumination), such as a flash of light, on-coming lights of a vehicle, glare, or the like. The greater ability of the light tolerant eye to resolve a visual target after incidence of light upon the eye is due to conditioning of the eye to the field of illumination generated by the inventive illumination device to maintain a reduced size of pupil or achieve greater tolerance to illuminance on the retina, or both. Certain embodiments of the inventive illumination device at chest height establish a field of illumination having beam center luminance of between 10 lux and 12 lux, 11 lux and 13 lux, 12 lux and 14 lux, 13 lux and 15 lux, 14 lux and 16 lux, 15 lux and 17 lux, 16 lux and 18 lux, 17 lux and 19 lux, 18 lux and lux, 20 lux and 30 lux, 25 lux and 35 lux at a distance of between 10 feet to 15 feet, between 15 feet to 20 feet, between 20 feet to 25 feet. By establishing the inventive illumination device at chest height, the angle of the light emitted from the inventive illumination device relative to the path or visual target can be adjusted to generate greater illuminance in the field of illumination with greater constancy as to location of the field of illumination relative to the eyes of the wearer.

Again referring to FIG. 2, as a non-limiting example, the wearer (2) of the inventive illumination assembly (16) having a portion of the emitted light (13) directed to the eyes (14) whether directly or from the field of illumination or both for a duration of time prior to incidence of the second light emission (15) (for example the light emitted from the headlights of an automobile on the eyes (14)) can avoid or reduce: flash blindness, after image, loss of visual acuity, or generally experience a greater ability, or a lesser reduction in the ability, to detect or resolve a visual target compared to the person without the light tolerant eye. As a specific example, a person (2) wearing the illumination assembly (1) at chest height which produces a field of illumination on a dimly lit background having illuminance at the center of the field of illumination of about 10 lux at about 15 feet to 20 feet can over a duration of time (one or more minutes) develop a light tolerant eye which has a significantly greater ability (or lesser reduction in ability) to resolve a visual target after incidence of a second light emission upon the eye of about 1000 lux to about 2000 lux or a flash of light or glare from headlights of a vehicle than when conditioned by conventional light devices such as those above-described.

Figure 4:
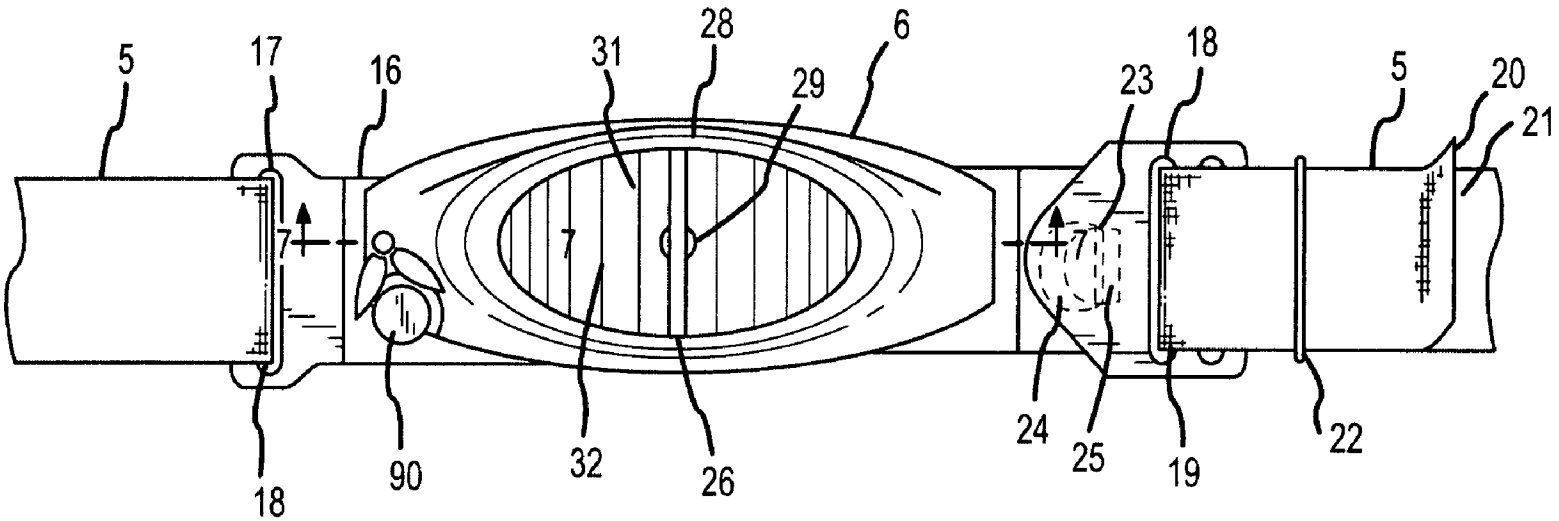
FIG. 4 is front view of a particular embodiment of the illumination invention.

Now referring to FIG. 4, a preferred embodiment of the inventive illumination device (1) is shown with the illumination assembly (6) coupled to the restraint (5). The restraint (5) has a length sufficient to encircle the wearer at chest height (4). The restraint (5) can comprise an elastic member or can be resiliently elastic to adjust to variation in the wearer's size or posture, whether at rest or during periods of activity. The restraint (5) can further provide a friction enhanced surface which engages the wearer's body. The friction enhanced surface can comprise raised or relief portions of the weave of the fabric. The restraint (5) can further provide one or more light reflection surfaces.

Now referring primarily to FIG. 4, the restraint (5) can be coupled to the opposed ends of a base (16) of the illumination assembly (6). As shown by FIG. 4, in a preferred embodiment of the invention, the ends of the restraint (5) can be passed through a slot(s)(17)(18) in the base (16) and each end of the restraint (5) secured to itself to provide a pair of terminal loops (18)(19). The terminal loops (18)(19) can provide releasable securement of the mated surfaces (20)(21) by further providing in the alternative mechanical fasteners, mated surfaces of hook and loop such as VELCRO®, or a compression element (22) to generate sufficient frictional engagement between the mated surfaces (20)(21) of the terminal loops (18)(19) to fix the relation between the mated surfaces (20)(21). Releasable securement of the mated surfaces (20)(21) of the terminal loops (18)(19) can further provide adjustable length of the restraint (5) by mating the first mated surface (20) to a second mated surface (21) having a different location on the restraint (5) to generate greater or lesser diameters of either of the terminal loops (18)(19).

One end of the restraint (5) can further include a clasp (23) which as shown in FIG. 4 can be located between the base (16) and the slot (18) in the base (16) to provide releasable securement of one end of the restraint (5) to the illumination assembly (6). The clasp (23) can comprise any manner of releasably mated portions (24)(25) of a mechanical fastener.

Figure 5:
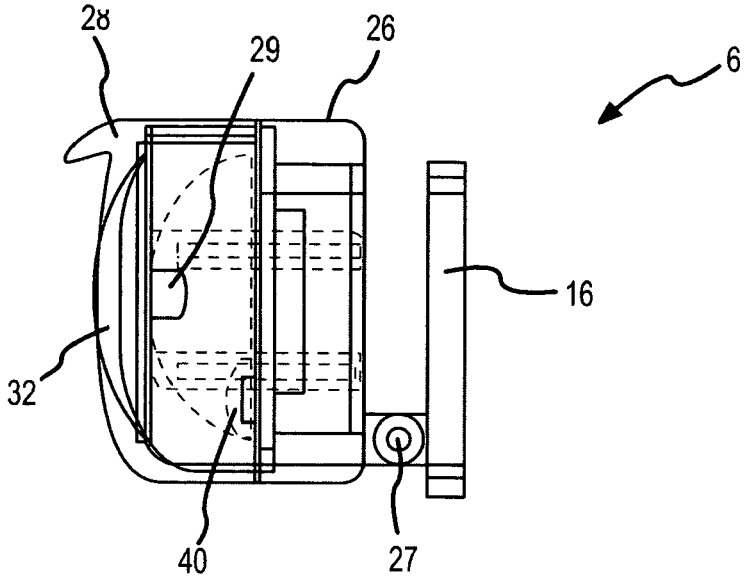
FIG. 5 is a side view of a particular embodiment of the illumination invention providing cross section 6-6.
Figure 6:
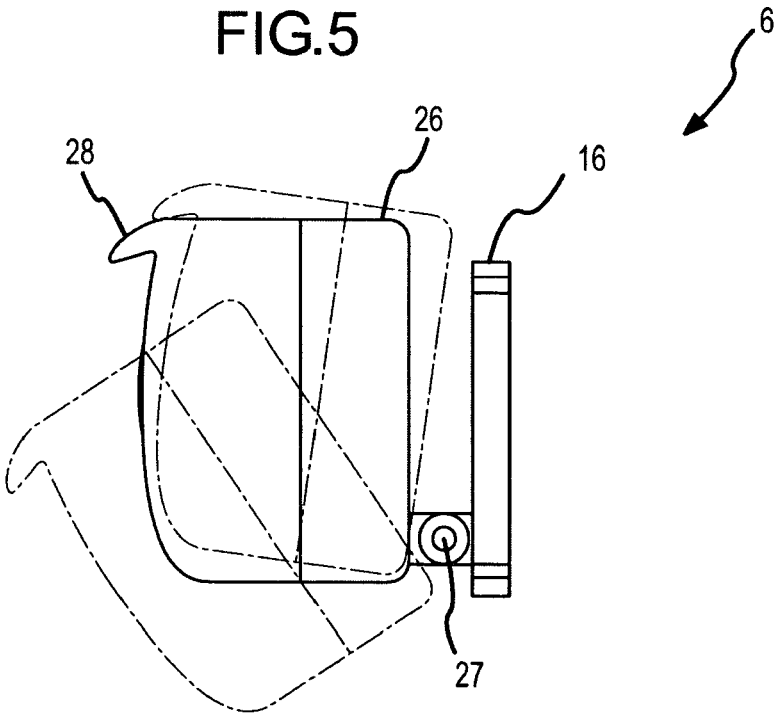
FIG. 6 is a side view of a particular embodiment of the illumination invention which shows the rotation of the main body to direct emitted light.

Now referring to FIGS. 5 and 6, the illumination assembly (6) can include a main body (26) coupled to the base (16). A preferred embodiment of the illumination assembly (6) further provides an axis of rotation (27) about which the main body and the base rotate, as shown by FIG. 6. Rotation of the main body (26) about the axis of rotation (27) provides directional adjustment of the emitted light (10) from the main body (26) of the illumination assembly (6). The main body (26) can further provide a rim (28) which projects a distance outwardly from the main body (26) at a location above a light emission source (29). The rim (28) projects from the main body (26) a distance sufficient to establish the proper illuminance (13) on the wearer's eyes (14). As to some embodiments of the invention, the rim (28) can project a fixed distance of between about one quarter and one half inch. As to other embodiments of the invention the rim (28) can project an adjustable distance between about one eighth of an inch and about one half of one inch.

Figure 7:
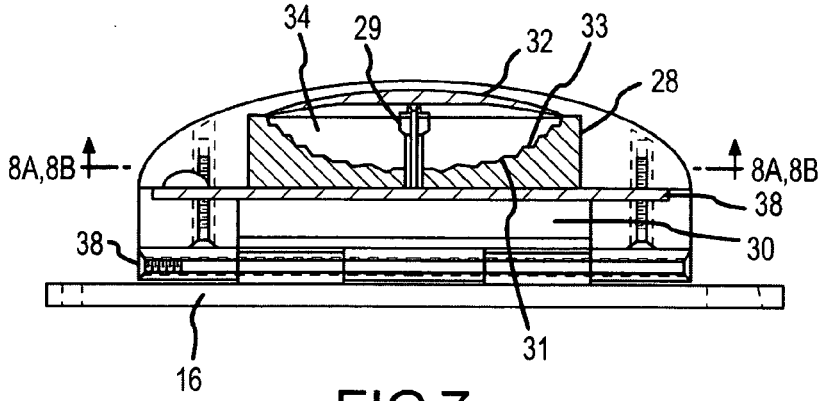
FIG. 7 is bottom view of a particular embodiment of the invention which provides section 7-7 which shows the interior of the main body.

Now referring to FIG. 7, the main body (26) can further include one or a plurality of light emission source(s) (29) responsive to a power source (30). In a preferred embodiment of the invention, the light emission source (29) can be a light emitting diode.

TABLE 1

| Material | Formula | Energy Gap | Wavelength |
|---|---|---|---|
| Gallium Phosphide | GaP | 2.24 eV | 550 nm |
| Aluminum Arsenide | AlAs | 2.09 eV | 590 nm |

TABLE 1-continued

| Material | Formula | Energy Gap | Wavelength |
|---|---|---|---|
| Gallium Arsenide | GaAs | 1.42 eV | 870 nm |
| Indium Phosphide | InP | 1.33 eV | 930 nm |
| Aluminum-Gallium Arsenide | AlGaAs | 1.42-1.61 eV | 770-870 nm |
| Indium-Gallium-Arsenide-Phosphide | InGaAsP | 0.74-1.13 eV | 1100-1670 nm |

Table 1 lists some common light emitter materials, the emission wavelength and corresponding energy gap. The first materials, GaP and AlAs, can be used to make light emission sources (29) which provide emitted light (10) in the visible portions of the spectrum which can be used in accordance with the invention. A particular embodiment of the invention can utilize the Luxeon brand by Lumileds which provides a bright illumination source (29) which can be operated with a 1.7 V lithium battery. Although, it is not intended that the light emission source (29) be limited to a light emitting diode and can be selected from a numerous and wide variety of light emission sources (29) such incandescent lamps, or the like.

In a preferred embodiment of the invention, the power source (30) can comprise a battery, a pair of batteries or a plurality of batteries. As shown by FIG. 7, the illumination assembly provides a power source compartment configured to receive three AAA batteries. However, the power source compartment can be alternately configured to receive a wide variety of battery configurations such as: AA, ½ AA, wafer cell, pin barrel, or the like. Certain embodiments of the invention can further include a battery charger whether discrete from or integral to the illumination assembly. The batter charger can be responsive to solar cells or other cells which convert light to energy.

Now referring primarily to FIGS. 4 and 7-9, the illumination assembly can further provide a reflector (31) which reflects emitted light (13) through a lens (32). The reflector (31) can further provide an arcuate surface (33) to adjust illuminance distribution over the entire surface of the lens (32). The configuration of the reflector (31) can be based on curves such as a parabola, semicircle, or cusp, or a combination thereof. All of these curves can provide arcuate reflector surfaces (33) which provide satisfactorily uniform illuminance distribution of emitted light (10) on the surface of the lens (32), if the configuration of illumination source (29), the interior configuration (34) of the main body (26) and the configuration of the reflector (31) are properly chosen.

As to certain embodiments of the illumination invention (1), the light emission source (29) can have a location proximate to the reflector (31), as shown by FIG. 9, while other embodiments of the illumination invention (1), the light emission source (29) can have a location distal from the reflector (31) as shown by FIG. 8. As to each of these embodiments of the invention, the arcuate reflector surface (33) will have a discrete configuration chosen to provide uniform illuminance distribution of emitted light (10) on the surface of the lens (32).

With respect to the embodiment of the invention locating the light emission source distal from the reflector, the arcuate reflector surface (33) of the reflector (31) can be configured to provide a parabolic arcuate surface. This allows the light emission source (29) to be located at substantially the focal point of the parabola allowing substantially all emitted light (10) to be reflected toward the lens (32) as a bundle of parallel light rays without substantial spherical aberration to increase the amount of illuminance incident to the lens (32).

Figure 8A:
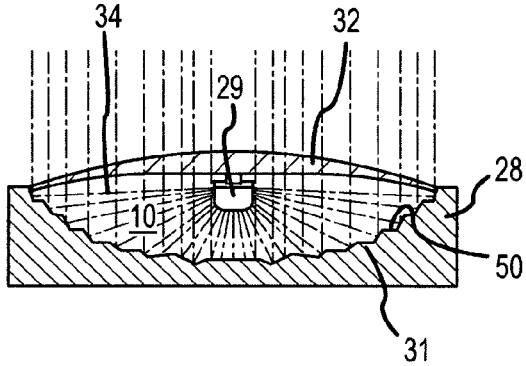
FIG. 8A is cross section 8A-8A which shows an alternate embodiment of the illumination invention which provides a light source located distal from the reflector.
Figure 8B:
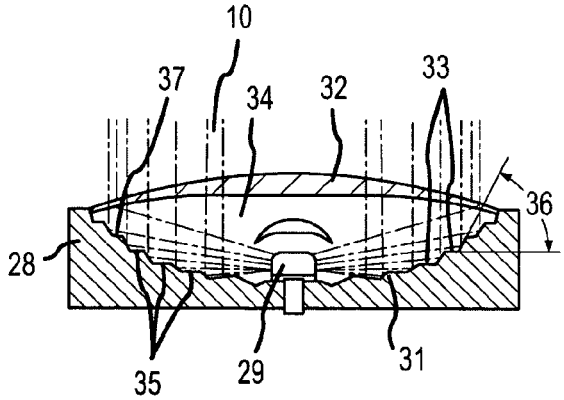
FIG. 8B is cross section 8B-8B which shows an alternate embodiment of the illumination invention which provides a light source located proximate to the reflector.

Now referring primarily to FIGS. 7 and 8A and 8B, the reflector (31) can further comprise a plurality of reflective facets (35) each having a facet angle (36) adjusted relative to the configuration and location of the light emission source (29) to reflect emitted light (10) to provide satisfactorily uniform illuminance distribution on the surface of the lens (32), or the plurality of reflective facets (35) and their relative placement on the reflector (31) can be tailored to provide an otherwise desired intensity distribution on the surface of the lens (32). Each of the plurality of facets (35) can have a flat surface (37) in order to minimize complexity, and any particular arcuate reflector surface (33) can be approximated by the use of the plurality of facets (35) having flat surfaces (37). The smaller each of the plurality of facets (35) coupled to the arcuate reflector surface (33), the closer the approximation to the desired arcuate reflector surface (33).

Now referring primarily to FIG. 7, the direction of the reflected emitted light (10) can be altered as it passes through the lens (32) by configuring the surface of the lens (32) with an amount of curvature. The lens (32) can to a greater or lesser degree as desired be converging or diverging through the use of convex, double convex, concave, double concave configurations or combinations or permutations thereof, to direct the emitted light as desired from the lens.

Now referring primarily to FIGS. 7 and 9, the illumination invention can further include a drive circuit (38) for the illumination source (29) which can be enabled with a switch (40). With respect to light emitting diode optical output (in those embodiments of the invention utilizing light emitting diodes) is approximately proportional to drive current. Other factors, such as temperature, also affect the optical output. FIG. 10 shows the typical behavior of a light emitting diode. Two curves are shown. The top curve (39) represents a 0.1% duty cycle with the peak current as shown on the horizontal axis. The bottom curve (40) shows the output with 100% duty cycle. Note the light versus current curve drops below the linear curve.

Now referring primarily to FIGS. 10-12, light emitting diodes are usually driven with either a digital signal or an analog signal. FIGS. 10-12 provide three configurations of illustrative analog light emitting diode drive circuits, although a variety of similar circuits or other circuits could be used, to drive a preferred embodiment of the invention which includes one or a plurality of light emitting diodes.

FIG. 10 illustrates the simplest of the three configurations. It uses a transistor, Q1, and a limited amount of resistors to convert an analog input voltage into a proportional current flowing through the light emitting diode located in the illumination assembly. The circuit shown by FIG. 11 works as follows: the small resistor, R1, prevents oscillations in Q1. The input voltage, $V_{IN}$, appears on the base of Q1. $V_{R2}$ is the voltage at the emitter of Q1, and it equals the base voltage minus 0.6 Volts. Since these base and emitter voltages only differ by a DC offset voltage, the AC portion of the base equals that of the emitter. The emitter voltage $V_{R2}$ causes a current equal to $V_{R2}$/R2 to flow through R2. Due to the nature of transistors, the Q1 collector current approximately equals the Q1 emitter current. (To be precise, the collector current equals b/(b+1) times the emitter current. The transistor current gain, b, is usually 10 to 100.) Collectively, we find that the LED current, and thus the output light, relates to the input voltage $V_{IN}$ as follows:

$$I_{D1} = \left(\frac{(V_{IN} - 0.6)}{R2}\right) \cdot \left(\frac{\beta}{(\beta + 1)}\right)$$

A drawback of the circuit shown by FIG. 10 can be that the base capacitance varies with the base voltage, which introduces nonlinearities that limit the circuit's linearity.

Now referring primarily to FIG. 11, the linearized, low frequency circuit shown in FIG. 5*b* eliminates most of the nonlinearities associated with Q1. In this case, U1 forms a feedback loop that drives the base of Q1 in such a way that assures that $V_{R2}$ equals $V_{IN}$. In this case, LED current, and thus the output light, relates to the input voltage $V_{IN}$ as follows:

$$I_{D1} = \left(\frac{V_{IN}}{R2}\right) \cdot \left(\frac{\beta}{(\beta + 1)}\right)$$

The circuit shown by FIG. 11 still experiences some lesser nonlinearities associated with Q1, but these do not represent the limiting factor. The circuit is limited by the delay associated with the feedback signal in the servo loop formed by U1, allowing the circuit to only achieve a bandwidth of about 10-100 MHz. This limitation makes the circuit shown by FIG. 12 work well in application transmitting direct current coupled analog signals.

FIG. 12 shows an alternate light emitting diode drive circuit. In this case, resistor, R1 supplies the DC current through D1. Sometimes, a constant current source or a network that includes temperature compensation replaces R11. A wideband RF amplifier, U1, serves two purposes. First it amplifies $V_{IN}$ to allow the use of a small input signal. Second, it isolates the light emitting diode from the input circuit, allowing precise impedance matching at the input, $V_{IN}$, which reduces reflections. The output of U1 is usually 50 Ohms or 75 Ohms. A typical light emitting diode may have an input impedance ranging from 5 Ohms to 10 Ohms. An impedance matching network is inserted between the amplifier and D1. Furthermore, capacitor, C1, serves to block any direct current level associated with the output of the matching network. This circuit drives the light emitting diode to the highest possible frequency.

Now referring to FIGS. 13-15, the illumination invention can alternately provide a digital drive circuit for the one or the plurality of light emitting diodes. The first circuit, shown in FIG. 13 is a simple series driver circuit. The input voltage is applied to the base of transistor Q1 through resistor R1. The transistor will either be off or on. When transistor Q1 is off, no current will flow through the light emitting diode, and no light will be emitted. When transistor Q1 is on, the cathode (bottom) of the light emitting diode will be pulled low. Transistor Q1 will pull its collector down to about 0.25 Volts. The current is equal to the voltage across resistor R2 divided by the resistance of R2. The voltage across R2 is equal to the power supply voltage less the light emitting diode forward voltage drop and the saturation voltage of the drive transistor. The key advantage of the series driver shown in FIG. 14 can be the low average power supply current. If one defines the peak light emitting diode drive current as $I_{LEDmax}$ and assumes that the light emitting diode duty cycle is 50%, then the average power supply current is only $I_{LEDmax}/2$. Further, the power dissipated is $(I_{LEDmax}/2) \cdot V_{SUPPLY}$ where $V_{SUPPLY}$ is the power supply voltage. The power dissipated by the individual components, the light emitting diode, transistor and resistor R1, is equal to the voltage drop across each component multiplied by $(I_{LEDmax}/2)$.

The second LED driver circuit, shown in FIG. 14 uses transistor Q1 to quickly discharge the LED to turn it off. This circuit will drive the LED several times faster than the series drive circuit shown in FIG. 13. The key advantage of the shunt drive circuit is that it gives much better drive symmetry. LED's are easy to turn on quickly, but are difficult to turn off because of the relatively long carrier lifetime. In the shunt driver circuit in FIG. 15, resistor R2 provides a positive current to turn on the LED. Typically, R2 would be in the 40 Ohm range. This makes the turn-on current about 100 mA peak. Transistor Q1 provides the turnoff current. When saturated, transistor Q1 will have an impedance of a few Ohms. This provides a much larger discharging current allowing the LED to turn off quickly. The key disadvantage of the shunt driver is the power dissipation. It is typically more than double that of the series driver.

FIG. 15, is a variation on the shunt driver shown in FIG. 15. Two additional resistors and two capacitors have been added to the basic circuit. Capacitor C1 serves to improve the turn-on and turnoff characteristics of transistor Q1 itself. One has to be careful that C1 is not made too large. If this occurs, the transistor base may be overdriven and damaged. The additional components, resistors R3 and R4 and capacitor C2, provide overdrive when the LED is turned on and underdrive when the transistor is turned off. The overdrive and underdrive accelerates the LED transitions. Typically, the RC time constant of R3 and C2 is made approximately equal to the rise or fall time of the LED itself when driven with a square wave.

Now referring primarily to FIG. 16, the illumination invention can provide the alternate digital drive circuit for the one or the plurality of light emitting diodes. With respect to this digital drive circuit, a preferred embodiment of the invention utilizing a Luxeon brand light emitting diode by Lumileds can provide a bright illumination source (29) which can be operated with a 1.7 V lithium battery, as above-described.

As to all the exemplary drive circuits shown, it is not intended that the invention be limited to the use of these drive circuits, rather the drive circuits disclosed are intended to illustrate the numerous and varied drive circuits available to drive light emitting diodes to generate light. As such, depending upon the application, the drive circuit for a particular embodiment of the invention may be one of the drive circuits shown, a similar drive circuit, or otherwise.

A variety of other embodiments of the chest height illumination system can be made to further include individually or in combination a heart rate monitor, a GPS tracking circuit, a radio, a timer, a pedometer, a compass, or the like. As to other embodiments of the invention, the restraint element (5) can be replaced with a variety of garments to retain the illumination assembly at chest height (or other height as desired) such as aprons, costumes, vests, waders, jackets, backpacks, personal flotation devices, or the like. As to other embodiments of the chest height illumination system, the main body (26) can detach from the base (16) for location on a stationary support surface such as helmets, handlebars of bicycles, underwater snorkeling or scuba gear, paint ball gear, and re-attached to the base (16).

As can be easily understood from the foregoing, the basic concepts of the present invention may be embodied in a variety of ways. The invention involves numerous and varied compositions or extracts obtained from plants of the genus *Hippophea* and methods of using such compositions or extracts to reduce loss of reproductive cell function.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "light" should be understood to encompass disclosure of the act of "lighting"—whether explicitly discussed or not—and, conversely, were there effectively disclosure of the act of "lighting", such a disclosure should be understood to encompass disclosure of a "light" and even a "means for lighting." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the illumination devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A method of using an illumination device, comprising the steps of:

a. providing an illumination assembly which generates a field of illumination;

b. coupling a restraint to said illumination assembly; and c. encircling a chest of a person with said restraint;

d adjusting length of said restraint encircling said chest of said person to engage said restraint to said chest of said person to maintain said illumination assembly at a chest height location.

2. A method of using an illumination device as described in claim 1, further comprising the step of locating said field of illumination through movement of said chest height location of said person.

3. A method of using an illumination device as described in claim 1, further comprising the step of uncoupling location of said field of illumination from movement of said person other than movement of said chest height location of said person.

4. A method of using an illumination device as described in claim 1, wherein said step of providing an illumination assembly comprises the step of providing a main body rotatably coupled to base.

5. A method of using an illumination device as described in claim 4, further comprising the step of locating said field of illumination by rotation of said main body of said illumination assembly.

6. A method of using an illumination device as described in claim 1, further comprising the step of affirmatively directing a part of said field of illumination to at least one eye of said person.

7. A method of using an illumination device as described in claim 6, further comprising the step of projecting a rim a distance outward from said main body to adjust said part of said field illumination directed to said at least one eye of said person.

8. A method of using an illumination device as described in claim 6, further comprising the step of generating a light tolerant eye in response to said field of illumination generated by said illumination device.

9. A method of using an illumination device as described in claim 8, further comprising the step of achieving in said light tolerant eye a greater ability to resolve a visual target after incidence of a light emission from a light source discrete from said illumination assembly.

10. A method of using an illumination device as described in claim 1, further comprising the step of achieving in said light tolerant eye a lesser reduction in ability to resolve a visual target after incidence of a light emitted from a light source discrete from said illumination assembly.

11. A method of using an illumination device as described in claim 1, wherein said step of coupling a restraint to said illumination assembly comprises coupling a first end of said restraint to said illumination assembly and releasably securing a second end of said restraint to said illumination assembly.

* * * * *